United States Patent [19]

Wishman

[11] 4,320,167

[45] Mar. 16, 1982

[54] NONWOVEN FABRIC AND METHOD OF PRODUCTION THEREOF

[75] Inventor: Marvin Wishman, Greenville, S.C.

[73] Assignee: Phillips Petroleum Company, Bartlesville, Okla.

[21] Appl. No.: 94,261

[22] Filed: Nov. 19, 1979

[51] Int. Cl.[3] ..... B29D 27/00; D04H 18/00

[52] U.S. Cl. ..... 428/288; 28/107; 28/112; 156/62.2; 156/62.4; 156/62.6; 156/62.8; 156/308.2; 428/95; 428/113; 428/294; 428/296; 428/300

[58] Field of Search ..... 428/95, 288, 296, 300, 428/113, 294; 28/107, 112; 156/62.2, 62.4, 62.6, 62.8, 308.2

[56] References Cited

U.S. PATENT DOCUMENTS

| | | | |
|---|---|---|---|
| 3,394,043 | 7/1968 | Parlin | 428/95 |
| 3,616,160 | 10/1971 | Wincklhofer | 428/296 |
| 3,801,428 | 4/1974 | Striegler | 428/296 |
| 3,817,820 | 6/1974 | Smith | 428/288 |
| 4,042,655 | 8/1977 | Platt | 264/25 |

*Primary Examiner*—Marion McCamish

[57] ABSTRACT

A nonwoven textile fabric comprising a needled and drawn batt comprising intermixed acrylic fibers and additional fibers selected from the group consisting of polyester fibers, nylon fibers and mixtures of polyester fibers and nylon fibers, with at least a portion of said additional fibers being fused and the acrylic fibers being essentially unfused. The nonwoven textile fabric is produced by forming a batt comprising the acrylic fibers and the additional fibers, drafting and needling the batt and fusing at least a portion of the additional fibers of the needled and drafted batt while allowing the acrylic fibers to remain substantially unfused. Fusing the additional fibers is preferably accomplished by means of infrared radiation.

60 Claims, No Drawings

NONWOVEN FABRIC AND METHOD OF PRODUCTION THEREOF

The invention relates generally to nonwoven fabrics. In one aspect the invention relates to a method of producing a nonwoven fabric batt. In another aspect the invention relates to a nonwoven textile fabric comprising a first quantity of substantially fused fibers and a second quantity of substantially unfused fibers.

In recent years the development of polymeric materials has exhibited tremendous growth. Polymeric materials lend themselves to a vast number of uses and applications. One of the more significant areas in which polymeric materials have been used is in the textile industry. The melt spinning of thermoplastic synthetic materials to produce continuous filaments, staple and yarns of such materials has revolutionized the textile industry.

Although much of the growth in the use of synthetic filaments has been in the area of knitted or woven fabrics, nonwoven materials of synthetic filaments also have experienced substantial growth. There are a number of methods known today for producing nonwoven fabrics from synthetic filaments and mixtures of natural and synthetic filaments. Nonwoven fabrics find a variety of uses. A specific area in which nonwoven fabrics have gained substantial acceptance is in the manufacture of carpets, particularly as the primary and/or secondary backing material. Since nonwoven fabrics made of synthetic fibers resist deterioration caused by mildew much better than jute, the material generally used for carpet backing, carpets made using synthetic nonwoven fabrics as the backing material are excellent carpets for use in areas exposed to moisture, such as patios and other outdoor areas.

Nonwoven fabrics are being used in many other areas as well. For example, nonwoven fabrics, both fused and unfused, are used as substrates in the production of various laminates and as ticking material in the furniture industry. Nonwoven fabrics are also quite useful as lining material for various garments such as jackets. Although nonwoven fabrics are useful in a variety of applications as indicated above, nonwoven fabrics can still be substantially improved especially with regard to their dimensional stability, shrinkage, strength, hand and methods of fusing the nonwoven fabric.

It is an object of the present invention to produce an improved nonwoven fabric.

Another object of the invention is to provide a partially fused, nonwoven fabric wherein a portion of the fibers thereof are substantially fused while the remaining portion of the fibers thereof are substantially unfused.

Yet another object of the present invention is to provide a partially fused, nonwoven fabric characterized by exceptional dimensional stability while exhibiting the appearance and textile-like hand of an unfused, nonwoven fabric.

Other objects, aspects and advantages of the invention will be apparent from a study of the specification and the appended claims.

According to the invention a novel nonwoven fabric is produced by forming a batt comprising acrylic fibers and additional fibers selected from the group consisting of polyester fibers, nylon fibers and mixtures of polyester and nylon fibers; drafting the batt; needling the batt; and fusing at least a portion of the additional fibers of the thus drafted and needled batt while allowing the acrylic fibers to remain substantially unfused.

In another aspect of the invention a nonwoven textile fabric is provided comprising a needled and drawn batt comprising intermixed acrylic fibers and additional fibers selected from the group consisting of polyester fibers, nylon fibers and mixtures of polyester fibers and nylon fibers; and at least a portion of the additional fibers being fused and the acrylic fibers being essentially unfused.

Apparatus suitable for the manufacture of a nonwoven textile fabric in accordance with the present invention is described in detail in U.S. Pat. No. 4,042,655 issued to Platt et al and assigned to the assignee of the present invention, which patent is incorporated by reference herein. Such apparatus includes batt-forming means comprising two web-forming trains in which feed means, such as bale breakers, blender boxes, feed boxes, etc., feed fibers in the form of staple, such as acrylic fiber staple, polyester fiber staple, nylon fiber staple, to breaker carding machines. The carding machines produce carded webs of intermixed fibers which are picked up by takeoff aprons of crosslappers. The crosslappers also comprise lapper aprons which traverse a carrier means, such as intermediate aprons, in a reciprocating motion thus laying webs to form intermediate batts on the intermediate aprons. The intermediate batts are passed to finisher carding machines by the intermediate aprons. The carding machines produce carded webs which are picked up by additional takeup aprons associated with additional crosslappers. The additional crosslappers also comprise additional lapper aprons which form a batt of fibers as the additional lapper aprons traverse a floor apron.

The carded webs passing from the additional crosslappers are laid on the floor apron to build up several thicknesses to produce the previously mentioned batt. It is pointed out that only means for forming a batt with the fibers oriented primarily in the fill direction is considered essential to practice the present invention, and such formation of a batt can be accomplished by any suitable means. As an example, only one feed means, carding machine, and crosslapper would be actually needed to form such a batt. The use of two carding machines, such as a breaker carding machine and a finishing carding machine and associated aprons and crosslappers, is not essential to practice the invention. The use of two carding machines tends to open up the fibers better to form a more uniform web and to provide some randomization of the staple fibers forming the webs which in turn form the batt; however, the fibers of the batt are still primarily oriented in the fill direction. Two web-forming trains or more can be advantageously used to increase the speed of the overall operation, and are thus considered optional.

As used throughout the instant specification, the term "fill direction" means the direction transverse to the direction of movement of the batt on the floor apron. The term "warp direction" means the direction parallel to the direction the batt moves on the floor apron, which is sometimes referred to as the machine direction.

Fist warp-drafting means, comprising at least two sets of nip rolls or an inlet apron and one set of nip rolls, is preferably used to draft the batt in the warp direction. As used herein, the terms stretching, drawing and drafting are synonymous. The first warp-drafting means suitably comprises five sets of nip rolls and the previously mentioned inlet apron and an outlet apron. Each set of nip rolls is preferably a one-over-two configuration, which provides excellent results, but almost any arrangement can be used such as a one-over-one, two-over-one, etc., as well as mixtures of nip roll configurations. The warp-drafted batt is then passed to a needle loom wherein the batt is needled at a suitable density, generally in the range of from about 100 to about 1000 punches per square inch (about 15 to about 155 punches per square centimeter) and more preferably in the range from about 300 to about 500 punches per square inch (about 46 to about 78 punches per square centimeter), and at any suitable penetration but generally at a penetration in the range from about 6 to about 19 millimeters. One or more needle looms can be used, and the needle looms can be either of the single needle board type or double needle board type.

The warp-drafted and needled batt is again preferably subjected to additional drafting in the warp direction by second warp-drafting means suitably comprising at least two sets of nip rolls or an additional inlet apron and one set of nip rolls. A batt which has been drafted in the warp direction both before and after needling is then preferably passed over a roll to fill-drafting means, such as a tenter frame. A suitable tenter frame comprises a fill-drafting section and a tensioning section. The tensioning section is not used to draft the batt, but is rather employed to subject the batt to tension in the fill direction subsequent to the application of fill drafting to the batt.

The fill-drafted batt is fused using infrared radiation, preferably while the batt is subjected to tension in the fill direction. Infrared heaters are preferably positioned adjacent to and on opposite sides of the unfused fabric batt. Either or both heaters can be used depending on the degree of fusion desired. It is preferred to fuse the fabric batt while it is subjected to tension in the fill direction because a fabric produced in such manner exhibits improved strength and dimensional stability. Furthermore, the use of infrared radiation to fuse the nonwoven fabric batt is preferred because the depth of fusion can be readily controlled and the integrity of the cross section of the various fibers can be readily maintained.

Quartz heaters and foil-strip heaters have been used as the infrared radiation source in accordance with the present invention; however, the present invention is not limited by any particular source used to subject the fabric to the infrared radiation. At the present time it appears that the foil-strip heaters are preferred because they provide better control of the fusion process.

The fused nonwoven fabric is normally passed on to suitable surge means such as a "J" box and multiple rolls. From the surge means the fabric is then ordinarily passed to suitable windup means over a plurality of rolls, normally comprising surge and idler rolls.

Synthetic thermoplastic fibers in the form of staple are passed to the previously mentioned carding machines to produce carded webs. The thermoplastic fibers comprise acrylic staple fibers and additional fibers selected from the group consisting of polyester fibers, nylon fibers and mixtures of polyester fibers and nylon fibers. While any suitable proportion of acrylic fibers and polyester and/or nylon fibers can be employed which will produce a nonwoven fabric having the desired characteristics of the present invention, the present nonwoven fabric generally comprises acrylic staple fibers in the range from about 50 to about 95 percent by weight based on the weight of the nonwoven batt and with the additional fibers being present in the nonwoven batt in an amount in the range from about 5 to about 50 percent by weight based on the weight of the batt. In a more preferred embodiment, the nonwoven fabric comprises intermixed thermoplastic synthetic fibers comprising acrylic staple fibers in an amount at least about 80 weight percent and additional fibers selected from the group consisting of polyester fibers, nylon fibers and mixtures of polyester fibers and nylon fibers in an amount at most about 20 percent by weight based on the weight of the nonwoven batt. Specific examples of desirable nonwoven fabrics include a nonwoven batt comprising about 80 percent by weight acrylic staple fibers and about 20 percent by weight polyester staple fibers which have been drawn, needled and fused by infrared radiation. Another example of a nonwoven fabric exhibiting desirable characteristics comprises a nonwoven batt comprising about 85 percent by weight acrylic fibers and about 15 percent by weight polyester fibers, with the batt being drawn, needled and fused by infrared radiation.

The desirable dimensional stability and textile-like hand of the nonwoven textile fabrics produced in accordance with the instant invention is submitted to be attributable to the utilization of infrared radiation for the fusion of the drawn and needled batts. While the additional fibers, selected from the group consisting of polyester fibers, nylon fibers and mixtures of polyester fibers and nylon fibers, are heated sufficiently to achieve at least partial fusion of at least a portion of these additional fibers, the acrylic fibers are much less responsive to infrared radiation heating than are the polyester and/or nylon fibers and are thus substantially unfused subsequent to the infrared radiation fusion step. Thus, the at least partially fused polyester and/or nylon fibers provide dimensional stability to the nonwoven batt while the essentially unfused acrylic fibers provide a desirable textile-like hand to the thus produced batt.

Enhancement of the textile-like hand of a nonwoven fabric produced in accordance with the present invention can be achieved by subjecting a partially fused nonwoven batt of acrylic fibers and additional fibers comprising polyester fibers and/or nylon fibers to suitable heat stabilization such as immersing the fabric in a heated liquid at a temperature at about 100° C. Such heat stabilization can be suitably achieved by immersing the nonwoven fabric in boiling water and/or by subjecting the fabric to a cationic dyeing step in a liquid bath at a temperature of about 100° C.

Suitable polyester fibers for use in the nonwoven fabric of the present invention include polyethylene terephthalate staple fibers. Suitable nylon fibers for use in the nonwoven fabric of the present invention include nylon 6 and nylon 66 staple fibers. As used herein, the term "acrylic fibers" refers to manufactured fibers in which the fiber-forming substance is any long-chain synthetic polymer composed of at least 85 percent by weight of acrylonitrile units.

Synthetic staple suitable for use in the present invention can be selected from staple having lengths ranging from about 3 to about 26 centimeters. Good results have been obtained employing a staple length ranging from about 6 to about 11 centimeters. Staple denier can be selected from a wide range of deniers. Normally the denier ranges from about 1 to about 20; however, deniers ranging from about 1.5 to about 8 are more common.

EXAMPLE I

A nonwoven fabric batt was produced in accordance with the present invention and was composed of about 80 percent by weight acrylic staple fiber and about 20 percent by weight polyethylene terephthalate polyester staple fiber. The nonwoven fabric was needled at a density of about 70 punches per square centimeter and at a penetration of about 16 millimeters, using 3-barb needles. In the warp-drafting zone the fabric was subjected to a draft ratio of about 1.3. The nonwoven fabric was passed by the infrared heaters at a rate of about 5.2 meters per minute. The infrared radiation was provided by 3 infrared heaters at about 450 volts. Samples of the thus produced nonwoven fabric were submitted to shrink testing at elevated temperature in an oven. Each sample was suspended in the oven by a suitable clip to permit the sample to freely shrink. The results of the shrink testing at elevated temperature are listed below in Table I.

TABLE I

| Temperature Treatment | Time of Treatment | Shrinkage, Warp Direction | Shrinkage, Fill Direction |
|---|---|---|---|
| 225° C. | 3 Min. | 14.1% | 8.3% |
| 200° C. | 3 Min. | 6.3% | 1.0% |
| 182° C. | 8 Min. | 5.2% | 0.5% |
| 165° C. | 8 Min. | 4.2% | 0.3% |
| 143° C. | 8 Min. | 3.1% | 0% |

From the shrink data set forth in the foregoing Table I, it will be seen that the nonwoven fabric sample produced in accordance with the present invention exhibited excellent dimensional stability and shrink resistance under elevated temperature. It will also be noted that all the temperatures to which the samples were subjected were in excess of the melt temperature of polypropylene which is a common thermoplastic fiber used in the production of nonwoven fabric suitable for carpet backing and lamination construction.

From the foregoing it will be seen that the novel process for the production of nonwoven fabric provides a novel nonwoven fabric which is characterized by substantially improved dimensional stability which is especially important when the fabric is to be used as carpet backing material. Moreover, the novel nonwoven fabric of the instant invention displays surprising shrink resistance under elevated temperatures, thus rendering the nonwoven fabric eminently suitable for use as a tufted carpet backing material due to its ability to maintain dimensional stability during the high temperature application of sintered thermoplastic, e.g. polyethylene, or latex adhesive to the backing material to secure carpet tufts thereto, and its ability to maintain dimensional stability under high temperature carpet cleaning conditions which might otherwise cause degradation of carpet backing material formed of thermoplastic fibers of lower melt temperature, e.g. polypropylene.

That which is claimed is:

1. A method of producing a nonwoven fabric comprising the steps of:

forming a batt comprising acrylic fibers and additional fibers selected from the group consisting of polyester fibers, nylon fibers and mixtures of polyester and nylon fibers;

drafting said batt;

needling said batt; and selectively fusing at least a portion of said additional fibers of said thus drafted and needled batt while allowing said acrylic fibers to remain substantially unfused.

2. A nonwoven fabric produced in accordance with claim 1.

3. A method in accordance with claim 1 wherein at least a portion of said additional fibers of said batt are fused by infrared radiation.

4. A nonwoven fabric produced in accordance with claim 3.

5. A method in accordance with claim 1 or claim 3 wherein said batt is heat stabilized subsequent to said fusing step.

6. A method in accordance with claim 5 wherein said batt is heat stabilized and dyed with a cationic dye in a liquid bath at about 100° C.

7. A method in accordance with claim 5 wherein said batt is heat stabilized in a liquid at about 100° C.

8. A nonwoven fabric in accordance with claim 7.

9. A method in accordance with claim 1 or claim 3 wherein said batt is simultaneously heat stabilized and dyed in a liquid bath at about 100° C. subsequent to said fusing step.

10. A method in accordance with claim 1 wherein said additional fibers are polyester fibers.

11. A method of producing a nonwoven fabric comprising the steps of:

forming a batt comprising acrylic fibers and additional fibers selected from the group consisting of polyester fibers, nylon fibers and mixtures of polyester and nylon fibers, wherein said acrylic fibers and said additional fibers are positioned generally in a first direction;

drafting said thus formed batt in a second direction, said second direction being generally normal to said first direction;

needling said thus drafted batt;

drafting said thus needled batt in said first direction; and selectively fusing at least a portion of said additional fibers of said batt subsequent to drafting said batt in the first direction while allowing said acrylic fibers to remain substantially unfused.

12. A nonwoven fabric produced in accordance with claim 11.

13. A method in accordance with claim 11 wherein at least a portion of said additional fibers of said batt are fused by infrared fusion subsequent to drafting said batt in the first direction.

14. A nonwoven fabric produced in accordance with claim 13.

15. A method in accordance with claim 13 wherein said batt is heat stabilized subsequent to said infrared fusing step.

16. A nonwoven fabric produced in accordance with claim 15.

17. A method in accordance with claim 13 wherein said batt is heat stabilized in boiling water subsequent to said infrared fusing step.

18. A nonwoven fabric produced in accordance with claim 17.

19. A method in accordance with claim 13 wherein said batt is simultaneously heat stabilized and dyed with a cationic dye in a liquid bath at about 100° C. subsequent to said infrared fusing step.

20. A nonwoven fabric produced in accordance with claim 19.

21. A method in accordance with claim 11 or claim 13 wherein said additional fibers are polyester fibers.

22. A method in accordance with claim 11 wherein at least a portion of said additional fibers of said batt are fused by infrared fusion subsequent to drafting said batt in the first direction but while said batt is still subjected to drafting tension in at least the first direction.

23. A nonwoven fabric produced in accordance with claim 22.

24. A method in accordance with claim 22 wherein said batt is heat stabilized subsequent to said infrared fusing step.

25. A nonwoven fabric produced in accordance with claim 24.

26. A method in accordance with claim 22 wherein said batt is heat stabilized in boiling water subsequent to said infrared fusing step.

27. A nonwoven fabric produced in accordance with claim 26.

28. A method in accordance with claim 26 wherein said acrylic fibers are present in said batt in an amount at least about 80 percent by weight and said additional fibers are polyester fibers and are present in said batt in an amount at most about 20 percent by weight based on the weight of said batt.

29. A nonwoven fabric produced in accordance with claim 28.

30. A method in accordance with claim 22 wherein said batt is simultaneously heat stabilized and dyed with a cationic dye in a liquid bath at about 100° C. subsequent to said infrared fusing step.

31. A nonwoven fabric produced in accordance with claim 30.

32. A method in accordance with claim 30 wherein said acrylic fibers are present in said batt in an amount at least 80 percent by weight and said additional fibers are polyester fibers and are present in said batt in an amount at most about 20 percent by weight based on the weight of said batt.

33. A nonwoven fabric produced in accordance with claim 32.

34. A method in accordance with claim 11 wherein said additional fibers are present in said batt in an amount in the range from about 5 to about 50 percent by weight and said acrylic fibers are present in said batt in an amount in the range from about 50 to about 95 percent by weight based on the weight of said batt.

35. A nonwoven fabric produced in accordance with claim 34.

36. A method in accordance with claim 22 or claim 34 wherein said additional fibers are polyester fibers.

37. A method in accordance with claim 11 wherein said additional fibers are present in said batt in an amount at most about 20 weight percent and said acrylic fibers are present in said batt in an amount at least about 80 percent by weight based on the weight of said batt.

38. A method in accordance with claim 11 wherein said acrylic fibers are staple fibers and are present in said batt in an amount at least about 80 percent by weight and said additional fibers are polyester staple fibers and are present in said batt in an amount at most about 20 percent by weight based on the weight of said batt.

39. A nonwoven fabric produced in accordance with claim 37 or claim 20.

40. A method in accordance with claim 11 wherein said batt is heat stabilized subsequent to said fusing step.

41. A nonwoven fabric produced in accordance with claim 40.

42. A method in accordance with claim 40 wherein said additional fibers are present in said batt in an amount in the range from about 5 to about 50 percent by weight and said acrylic fibers are present in said batt in an amount in the range from about 50 to about 95 percent by weight based on the weight of said batt.

43. A nonwoven fabric produced in accordance with claim 42.

44. A method in accordance with claim 11 wherein said batt is heat stabilized in boiling water subsequent to said fusing step.

45. A nonwoven fabric produced in accordance with claim 44.

46. A method in accordance with claim 44 wherein said additional fibers are present in said batt in an amount in the range from about 5 to about 50 percent by weight and said acrylic fibers are present in the range from about 50 to about 95 percent by weight based on the weight of said batt.

47. A nonwoven fabric produced in accordance with claim 46.

48. A method in accordance with claim 11 wherein said batt is simultaneously heat stabilized and dyed with a cationic dye in a liquid bath at about 100° C. subsequent to said fusing step.

49. A nonwoven fabric produced in accordance with claim 48.

50. A method in accordance with claim 48 wherein said additional fibers are present in said batt in an amount in the range from about 5 to about 50 percent by weight and said acrylic fibers are present in the range from about 50 to about 95 percent by weight based on the weight of said batt.

51. A nonwoven fabric produced in accordance with claim 50.

52. A method in accordance with claim 11 wherein said acrylic fiber and said additional fibers are staple fibers.

53. A nonwoven textile fabric comprising:

a needled and drawn batt comprising intermixed acrylic fibers and additional fibers selected from the group consisting of polyester fibers, nylon fibers and mixtures of polyester fibers and nylon fibers; and at least a portion of said additional fibers being selectively fused and said acrylic fibers being essentially unfused.

54. A nonwoven textile fabric in accordance with claim 53 wherein said additional fibers are present in said batt in an amount in the range from about 5 to about 50 percent by weight and said acrylic fibers are present in said batt in an amount in the range from about 50 to about 95 percent by weight based on the weight of the batt.

55. A nonwoven fabric in accordance with claim 53 wherein said additional fibers are present in said batt in an amount in the range from about 5 to about 20 weight percent and said acrylic fibers are present in said batt in an amount in the range from about 80 to about 95 percent by weight based on the weight of said batt.

56. A nonwoven textile fabric in accordance with claim 53 wherein said acrylic fibers are present in said batt in an amount at least about 80 percent by weight and said additional fibers are present in said batt in an amount at most about 20 percent by weight based on the weight of said batt.

57. A nonwoven textile fabric in accordance with claim 53 wherein said acrylic fibers are present in said batt in an amount at least about 80 percent by weight and said additional fibers are polyester fibers and are present in said batt in an amount at most about 20 percent by weight based on the weight of said batt.

58. A nonwoven textile fabric in accordance with claim 53 or claim 54 wherein said additional fibers are polyester fibers.

59. A nonwoven fabric in accordance with claim 58 wherein said acrylic fibers and said polyester fibers are staple fibers.

60. A nonwoven fabric in accordance with claim 53 wherein said needled and drawn batt is heat stabilized.

* * * * *